United States Patent [19]

Faulin

[11] 4,284,292

[45] Aug. 18, 1981

[54] SKI FASTENER STRUCTURE

[76] Inventor: Antonio Faulin, Via G. da Procida, 4-Milano, Italy

[21] Appl. No.: 41,443

[22] Filed: May 21, 1979

[30] Foreign Application Priority Data

May 24, 1978 [IT] Italy ..... 23763 A/78

[51] Int. Cl.[3] ..... A63C 9/08

[52] U.S. Cl. ..... 280/618; 36/117; 280/11.36; 280/613; 280/614

[58] Field of Search ..... 280/618, 613, 611, 614, 280/11.36; 36/117

[56] References Cited

U.S. PATENT DOCUMENTS

| | | | |
|---|---|---|---|
| 1,598,504 | 8/1926 | Pierce et al. | 280/11.36 X |
| 3,955,825 | 5/1976 | Kubelka et al. | 280/618 |
| 4,058,326 | 11/1977 | Faulin | 280/617 |
| 4,168,085 | 9/1979 | Faulin | 280/618 |

FOREIGN PATENT DOCUMENTS

| | | | |
|---|---|---|---|
| 2224057 | 12/1972 | Fed. Rep. of Germany | 280/618 |

*Primary Examiner*—Joseph F. Peters, Jr.
*Assistant Examiner*—Milton L. Smith
*Attorney, Agent, or Firm*—Guido Modiano; Albert Josif

[57] ABSTRACT

A ski fastener structure has a rigid bar element removably fixable to a ski and engaging the lower end of a rod element pivotable about a horizontal axis substantially perpendicular to the ski longitudinal axis. The rod element is effective to resiliently encircle a rear region of the skier's leg at the middle area of the tibia and the skier's footwear is removably connected to the bar element.

21 Claims, 23 Drawing Figures

52
56
55
59
57
58

52
55
57
51
52
56
30b
54
30a
30

30
18
17
60
2
1
10
32
13
33
11a
66
11a
12
62
41
68
50
69
120
70
71

18
16
17
6
21
19
1
20
16
6
17
18
19
20
21
1

16
17
1
6
21
19
18
20

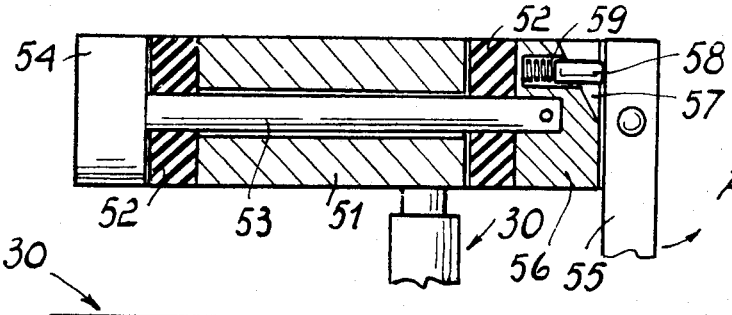
Fig. 11
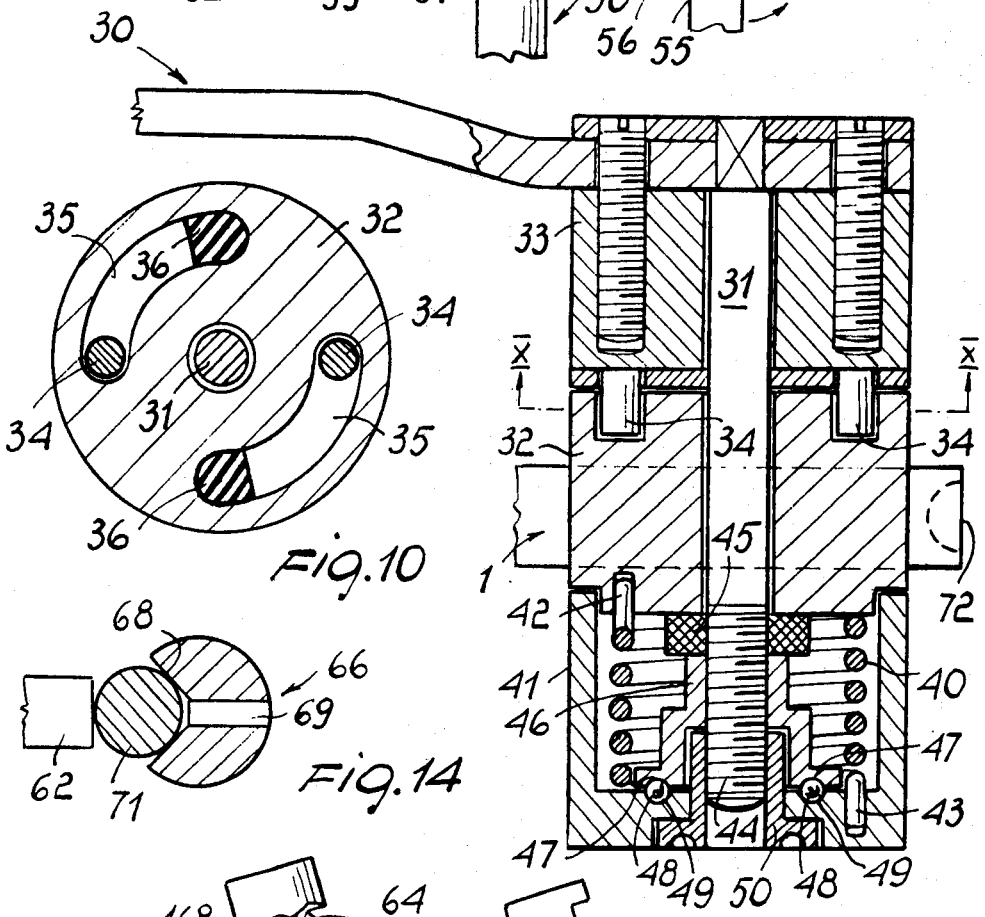
Fig. 10
Fig. 9
Fig. 14
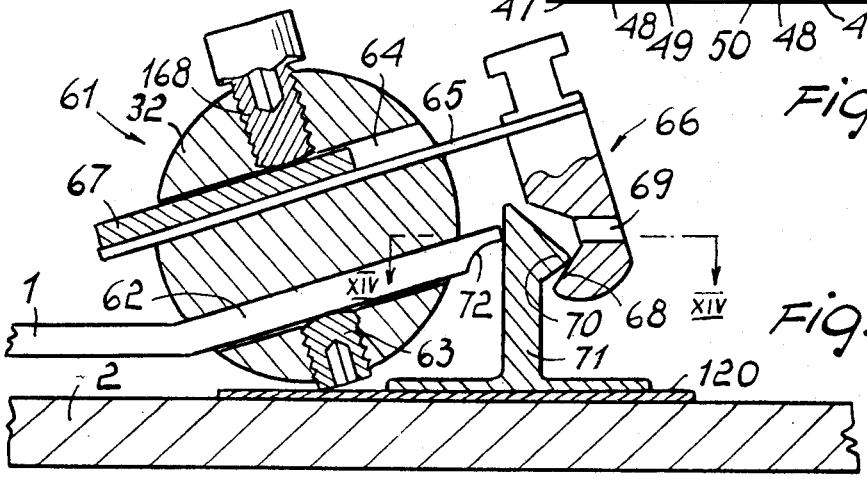
Fig. 13

SKI FASTENER STRUCTURE

BACKGROUND OF THE INVENTION

This invention relates to a ski fastener structure.

In my prior U.S. Pat. Nos. 4,058,326 and 4,168,085 fasteners have been described which feature in common the utilization of a "soft" type of footwear by the skier, yet without impairing the so-called "corner holding ability".

Fasteners of the type disclosed in the above Patents generally comprise a plate-like element which is secured to a respective ski through automatic latch and release means, and which pivotally supports a rod-like element which becomes located, in practice, on one side of the skier's leg, at the tibia area.

Such fasteners are also provided with means for removably engaging the sole of the skier's footwear with said plate-like element.

In skiing with the fasteners mentioned above, it occurs that a shaped portion of the top or upper end of the rod-like element is located on the front side of the skier's leg, at a point of the tibia area, while the skier is afforded the possibility of flexing his leg forwards against the bias of elastic means which urge the cited rod-like element against the skier's leg in a forward sloping position.

The solution just described, while issueing generally satisfactory results, could be further improved; moreover, with the fasteners mentioned above, straps or belt elements, or the like, are required to connect the rod-like element to the skier's leg and to complete the connection of the skier's footwear to the plate-like element.

These means, while proving valid from a merely functional standpoint, have caused some inconvenience to the user; moreover, through the fasteners described hereinabove, the connection of the sole to the plate-like element developed some problems, especially in view of the environmental conditions in which skis are usually used.

SUMMARY OF THE INVENTION

Thus, this invention sets out to provide a ski fastener structure, which while permitting, similarly to the types mentioned above, a soft footwear to be used for skiing, thus relating itself to the same concept that stands behind the patents mentioned in the foregoing, also affords a considerable simplification of all the operations related to the connection of the skis to the skier's legs.

Within that general aim, it is another object of the invention to provide a ski fastener structure that is composed of extremely simple means and accordingly is such as to be free from binding and damage.

It is further an object of the invention to provide a ski fastener structure which ensures the highest degree of reliability and protection for the skier's articulations.

According to one aspect of the present invention, there is provided a ski fastener structure comprising a substantially rigid bar element effective to be removably fixed to a ski through automatic-release latching means, with said bar element pivotally engaging the lower end of a rod-like element arranged to pivot about an axis substantially perpendicular to the ski longitudinal axis and parallel to the surface of the ski, wherein said rod-like element, at the top or upper end thereof, encircles a rear region of the skier's leg at a middle area of the tibia, resilient means being provided to act on said rod-like element such as to hold said upper or top end of said rod-like element in contact with said rear region of the skier's leg, means being further provided for removably connecting the skier's footwear to said bar element.

BRIEF DESCRIPTION OF THE DRAWINGS

Further features and advantages will be more clearly apparent from a detailed description of preferred embodiments, of a ski fastener structure, illustrated by way of example and not of limitation in the accompanying drawings, where:

FIG. 9 is a detail sectional view of the connection of the rod-like element to the bar element;

FIG. 10 is a sectional view taken along the line X—X of FIG. 9;

FIG. 11 shows in section a detail view of the top or upper end of the rod-like element;

FIG. 13 shows, in longitudinal section, one embodiment of the rear latching means;

FIG. 14 is a sectional view taken along the line XIV—XIV of FIG. 13;

DESCRIPTION OF PREFERRED EMBODIMENTS

Figures 1, 4, 5, 6, 12:
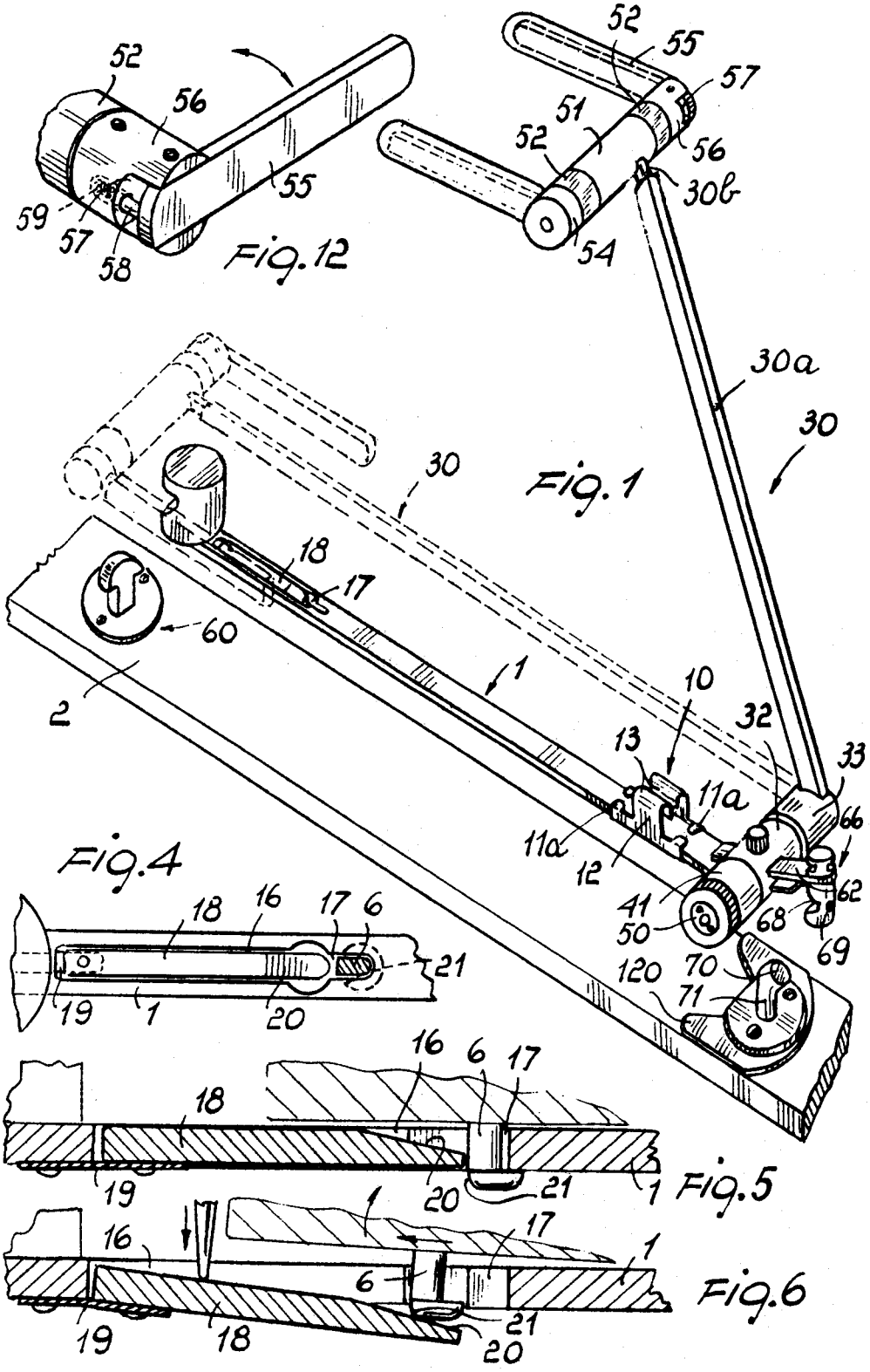
FIG. 1 shows schematically and in perspective a ski fastener structure according to one embodiment of this invention.
FIG. 4 is a top plan view of means for locking the footwear tip.
FIG. 5 shows the means for locking the footwear tip, in longitudinal section.
FIG. 6 shows the means for locking the foremost tip or toe end of the footwear during the disengagement stage.
FIG. 12 shows in perspective a portion of the top or upper end of the rod-like element.

With reference to the drawing figures, and with the term "horizontal plane" intended to indicate the surface plane whereon the footwear sole rests when fitted to the ski, the ski fastener structure of this invention comprises a bar element 1, which is substantially rigid and has a set degree of flexibility in the vertical plane through the ski longitudinal axis, it being preferably but not unavoidably composed of a metal flat member or the like. The bar element 1 has a prevailingly longitudinal dimension and can be removably attached or fixed to a ski, indicated at 2, through automatic-release front and rear latching means which will be described hereinafter.

Figures 2, 3, 7, 8:
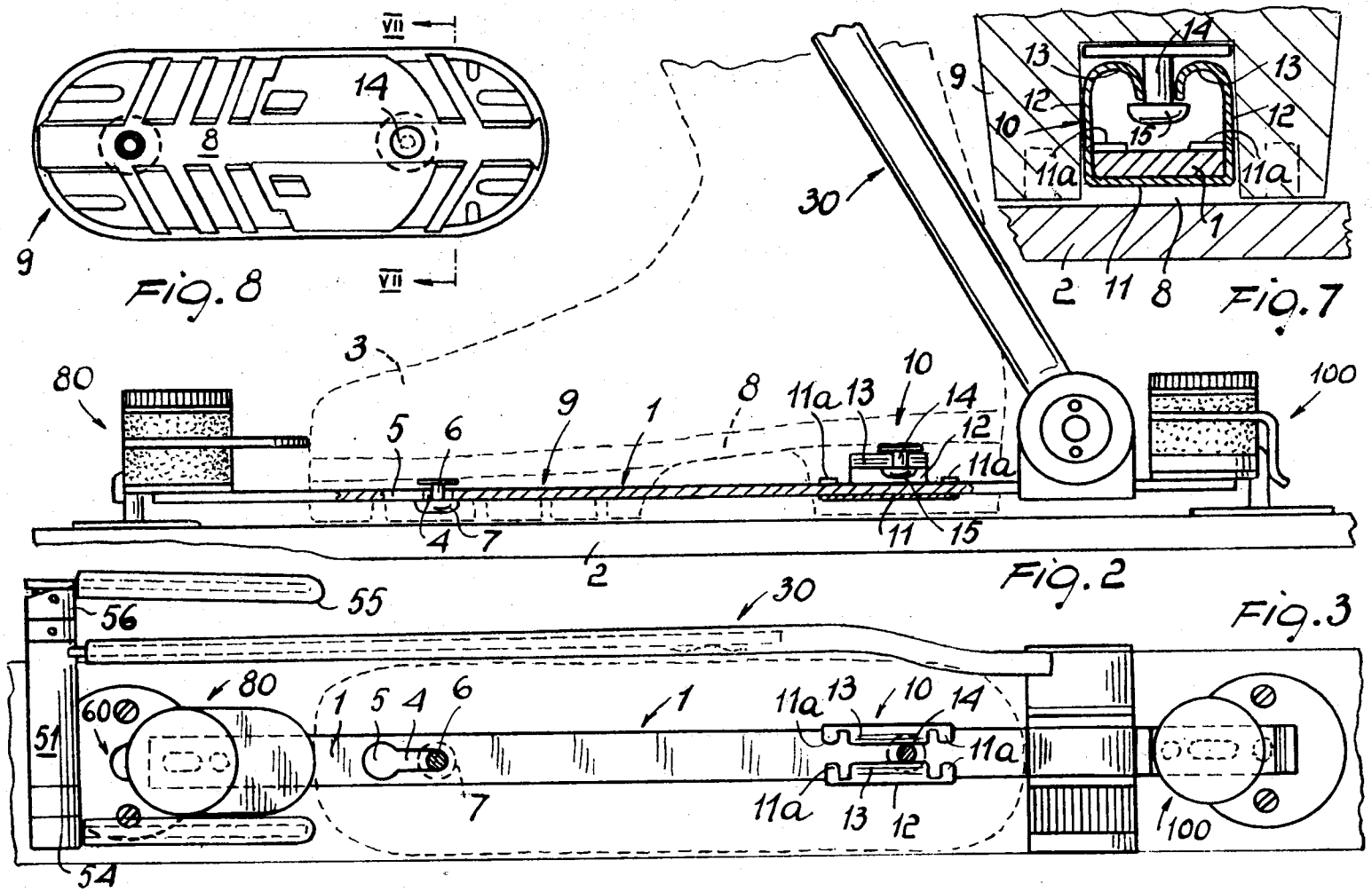
FIG. 2 is a side elevational view of the ski fastener structure.
FIG. 3 is a top plan view of the ski fastener structure.
FIG. 7 is a sectional view taken along the line VII—VII of FIG. 8, showing the means for connecting the rear portion of the footwear to the bar element.
FIG. 8 shows schematically, in plan view, the footwear sole.

To said bar element 1, there can be connected a boot or footwear member indicated at 3, through means which include front connecting means and rear connecting means. Said front connecting means comprise, as shown in FIGS. 2 and 3 an elongate hole or slot 4 in the front portion of the bar element with a front end portion 5 which is widened and engageable with a front pin or stud 6 having a widened head 7 with a cross dimension greater than the elongate slot 4 and less than the widened portion 5, said pin or stud being accommodated in the front sole portion of the footwear 3 and projecting into a middle channel 8 provided longitudinally in the sole 9 of the footwear 3.

The rear connecting means comprise a resilient reed, generally indicated at 10, of substantially U-like shape arranged at the rear portion of the bar element 1. Said reed 10 has its lower portion 11 arranged underneath the bar element 1; from the sides of the lower portion 11, there extend two side arms 12 which raise upwards and terminate each in a downwardly bent edge 13. The edges 13 are oriented toward each other such as to define in practice a seat for accommodating a rear pin or stud 14 therein, which is provided on the rear sole portion of the footwear 3 and projects into the longitudinal channel 8. The pin or stud 14 has a widened head 15, which during the insertion step overcomes the resilient resistance presented by the curled edges 13, but is prevented from disengaging itself upwardly from the reed 10, excepting by application of a predetermined pulling effort, since the curled edges are engaged underneath by the widened head 15. Moreover, at the ends of the portion 11, there are provided small hook members or catches 11*a*, which by encircling the bar 1 ensure the coupling of the reed 10 to the bar 1, to only permit longitudinal movement for the reed 10 along the bar 1 in circumstances which will be made clear hereinafter.

To fasten the footwear 3 to the bar element 1, it will be sufficient that the user first inserts the widened head 7 of the front pin 6 into the widened portion 5 of the slot 4, thereafter, having brought the front pin or stud 6 to the narrow portion of the slot 4, such that it cannot disengage itself upwardly from the slot owing to the widened head 7, it will be sufficient for the user to apply a certain downward pressure at the heel, thereby the widened head 15 of the rear pin or stud 14 overcomes the resilient resistance of the curled or bent over edges 13 of the elastic resilient reed 10, such as to cause the pin or stud itself to penetrate between the curled edges 13 to provide the locking action mentioned above.

For disengaging, it will be sufficient that the footwear 3 is moved to slide forward on the bar element 1 and bring the widened head 7 back to the widened portion 5 of the slot 4, thereby the front pin or stud 6 becomes disengaged, and the rear pin or stud 14 is caused to slide longitudinally with respect to the reed 10 to disengage itself therefrom.

It should be pointed out here, that it is possible, if desired, to cause the reed 10 to slide longitudinally along the bar element 1 such that the reed is no longer positioned at the rear pin or stud 14; this latter solution may be adopted where long-range skiing is practiced, in which case it may be advisable and indeed preferable that the footwear heel is left free from the fastener.

When the above-described type of front connecting means is used, it becomes necessary to use means effective to prevent the footwear 3 from sliding forward with respect to the bar element 1, in ski practicing; such means will be described hereinafter together with a further embodiment of front connecting means.

According to this further embodiment of the front connecting means for securing the footwear 3 to the bar element 1, as illustrated in FIGS. 4 to 6, it is possible to provide an elongated slot 16 through the front portion of the bar element 1 which has an intermediate widened portion and terminates in a narrowing portion 17 at the rear end of the slot 16. Through said slot 16, there is inserted a tab element 18 which is hinged at the front end to the bar element 1 through a resilient reed member 19; moreover, at the opposing side with respect to the reed 19, i.e. at the rear end, the tab element 18 has a lead-in taper 20, and the front pin or stud 6 may be formed with a front bevel 21 on its head, such as to be preferably flush with the stem of the pin or stud 6 at the front portion thereof.

Insertion for latching the front of the footwear 3 to the bar element 1 is simply effected by laying the head 7 onto the tab element 18 and causing the tab element to move downwards against the resilient bias provided by the reed 19, thereafter, once the head 7 has been inserted through the slot 16, the pin 6 is caused to slide rearwards as far as it reaches the narrowing portion 17 where the head 7 remains anchored underneath the bar element 1. The tab element 18, in returning to its upper position inside the slot 16 by the action of the reed 19, engages with its free end the pin or stud 6, thus defining an abutment for the pin or stud 6 and preventing the pin or stud, and accordingly the footwear 3, from sliding forwards. In order to disengage the footwear 3, it will be sufficient to depress the tab element 18 downwards, preferably by utilizing the tip of the sticks used in skiing, such as to lower the tab element 18 and allow the pin 6 to be disengaged from the narrowed portion 17, and in particular the head 7 thereof to be disengaged from below the bar element 1, in the reverse order to the above-described procedure for the latching step.

In the proximity of the rear end, with respect to the main dimension of the ski, of said bar element 1, there is articulated to the bar element 1 the lower end of a rod-like element, indicated generally at 30, which is pivotable about an axis lying substantially perpendicular to the ski main longitudinal direction and parallel to the surface of the ski.

The point of connection between the bar element 1 and rod-like element 30 is located, in the solution proposed by this invention, rearwardly with respect to the footwear 3.

The connection is effected through the intermediary of a pin 31 made rigid by means known per se with the lower end of the rod-like element 30, and pivotably connected to a body 32 made rigid with said bar element 1. More specifically, the rod-like element 30 and the pin 31 are rigid with a block 33 which is laid beside the body 32 to face it, and has a pair of stop pegs 34 positioned diametrically opposite with respect to the cross pin 31 and each slidably accommodated in a respective keyway 35 provided in the body 32 and contoured as a portion of a circle. The engagement between the pegs 34 and the ends of the keyways 35 practically defines respectively a front stop and a rear stop for the pivotal movement of the rod-like element 30 with respect to the bar element 1.

Furthermore, at the end of the keyways 35 defining said rear stop, there are provided respective elastic blocks 36 which serve as elastic detents for the rod-like element 30 when rotated backwards and afford a degree of elasticity at the rear stop point, at which point the rod-like element 30 is in a raised position and accordingly, in practice, in the operative position thereof.

Said rod-like element 30, and here is an important feature of the invention, is acted upon by resilient means having the function of holding the upper or top end of the rod-like element 30, which will be described hereinafter, in contact with the rear portion of the skier's leg at the calf, said resilient means comprising of preference a coil spring 40 accommodated within a cup element 41 which is carried on the pin 31, at the side of the body 32 opposite with respect to the block 33 and rod-like element 30. Said coil spring 40 has one end 42 thereof made rigid with the body 32 on the opposite side with respect to the block 33, while its other end 43 is rigid with the cup element 41. Said cup element is rotatable about the pin 31 and can be locked in a desired angular position with respect to the pin 31. More specifically, the pin 31 has at its end opposite to the rod-like element 30 a threaded portion 44 wherewith a locknut 45 engages to which a cup-like member 46 is affixed having on its front end facing the cup element 41 a plurality of recesses 47 in which small balls 48 are engageable which are accommodated in opposite mating recesses or counterrecesses 49 defined on the inner face of the cup element 41; also provided is a tightening locknut 50 which urges the cup element 41 axially against the cup-like member 46 to prevent it from rotating about the pin 31, owing to the provision of the balls 48. The cited resilient means acting on the rod-like element 30 are adjustable as desired; to this aim, it will be sufficient to release the locknut 50 and manually rotate the cup element 41 to load or wind the spring 40 to the desired extent; then, through the locknut 50, the cup element 41 is again tightened, thus bringing the balls 48 into the recesses 47, to prevent, as mentioned above, the relative rotation of the cup element 41 with respect to the pin 31, while the desired resilient force is applied to the rod-like element 30.

As mentioned in the foregoing, the rod-like element encircles with its upper or top end the rear portion of the skier's leg at the calf: to provide the engagement between the skier's leg and the rod-like element 30, there is provided a cross sleeve 51, which is rigid with the top or upper end of the rod-like element 30 and within which a cross pin 53 is rotatable against the bias of elastic friction pads 52 acting on the ends of the sleeve 51. The end portions of the cross pin 53 project from the sleeve 51 and carry respectively a fixed arm 54 and a resiliently divaricable arm 55; the arms 54 and 55 in conjunction with the cross sleeve 51 form in practice a U-like body which encircles the leg rear. The resiliently divaricable arm 55 has one end pivoted to a yoke element 56 about an axis extending transverse to the cross pin 53. The yoke element 56 is secured to one end of the cross pin 53 between the divaricable arm 55 and the pad 52, and has on one side a bevel 57 wherefrom a plunger 58 projects whereon a spring 59 is active for urging the plunger 58 resiliently against the end of the arm 55, which is thus enabled to be divaricated outwardly against the elastic bias of the spring 59.

The arms 54 and 55, which are joined together by the cross pin 53, are mounted for common rotation about the cross sleeve 51 such as to afford a position of minimum bulk, as shown schematically in dotted lines in FIG. 1, whenever the ski fastener structure must be set for transport.

It will be appreciated that the shape of the leg-engaging body may be other than U-like, its only function being that of encircling the rear of the skier's leg calf.

It should be added to the foregoing that the rod-like element 30 is preferably of telescopic construction, with an outer hollow rod member **30*a* which is rigid with the cited block 33 and a lengthwise slidable inner rod portion 30*b* which is rigid with the cross sleeve 51; moreover, to prevent rotation about the rod-like element axis, the outer hollow rod member 30*a* and inner rod portion 30*b*** could be made oval in cross-section or otherwise configurated to prevent any relative rotational movement while permitting the telescoping sliding movement. Preferably, though not necessarily, the inner portion of the U-like body is suitably padded for protection.

The cited bar element 1, as mentioned hereinabove, can be connected to the ski through automatic release latching means which, according to a first embodiment as shown more clearly in FIGS. 1, 13 and 14, comprise on the front a simple yoke element rigid with the bar element 1 and adapted for insertion onto a front latching or securing pin, indicated at 60 and secured to the ski 2, while on the rear, automatic release rear latching means, generally indicated at 61, will be provided in this instance, as shown best in FIGS. 13 and 14.

As shown more clearly in FIG. 13, the bar element 1 has at its rear end a top inclined portion 62 which is adapted for insertion into a through slot provided in said body 32 and lockable by means of a locking pin 63, thereby the body 32 can be positioned as desired with respect to the inclined portion 62 for an optimal adjustment of the ski fastener.

Said body 32 has, above the slot wherewith the portion 62 is engaged, a through channel or slot 64 wherein a resilient plate 65 can be accommodated which has at its free rear end a catch piece or hook-up tailpiece 66, which will be described more clearly hereinafter. Moreover, in said through channel 64, in overlapping relationship with the resilient plate 65, a rigid plate 67 is provided which can be positioned adjustably with respect to the resilient plate 65 such as to vary, in practice, the useful length of the resilient plate 65 and accordingly the degree of resiliency thereof. Also provided is a lockscrew 168 which is screwed into the body 32 and engages against the rigid plate 67 to lock it in any desired position, together with the resilient plate 65.

The catch piece or tailpiece 66 has a concave seat 68 facing forward, from the bottom whereof there extends a snow discharging through hole 69 which serves for preventing any occasional snow build-up within the seat 68. The seat 68 cooperates with the edges of a projection 70 arranged to face and enter the seat 68 and formed on a rear latching pin or stud 71 affixed to the ski 2.

It should be further added to the above that, at its free end, the inclined portion 62 of the bar element 1 has a lead-in bevel, indicated at 72.

To latch the rear end of the bar element 1 to the ski 2, after carrying out the adjustments described above, it will be sufficient to bring the lead-in bevel 72 to rest onto the rounded head of the rear latching pin or stud 71 and apply a certain pressure such as to overcome the resiliency of the resilient plate 65 and engage the seat 68 with the corresponding edge of the projection 70.

Through this arrangement, by providing the seat 68 with suitable surfaces wherealong the edges of the projection 70 can slide, a release force can be developed by application of an upward pull which bears a determined ratio with respect to an effort exerted sideways to the right and left, namely, and as is normally required, the rear latch is more easily released sidewards with respect to an upwardly directed pulling effort, which is more easily tolerated by the skier's articulations. Moreover, the effort required to engage the projection 70 and seat 68 vertically is much smaller than the effort required to disengage them.

An important feature of this invention is that the front and rear latching means, contrary to what is experienced with conventional means, do not work in compression; in fact, with automatic release fasteners of conventional design, it happens that the heel piece of the ski binding and toe piece cooperate in practice with each other to clamp the boot, with a mutual compressive action, therebetween and against the ski. By contrast, and as illustrated in the foregoing, in the present ski fastener structure release is only provided at the rear, whereas at the front, an element is arranged which is effective to hold in position the bar element 1 without being involved in the release operation other than as a hinge element.

Figure 15:
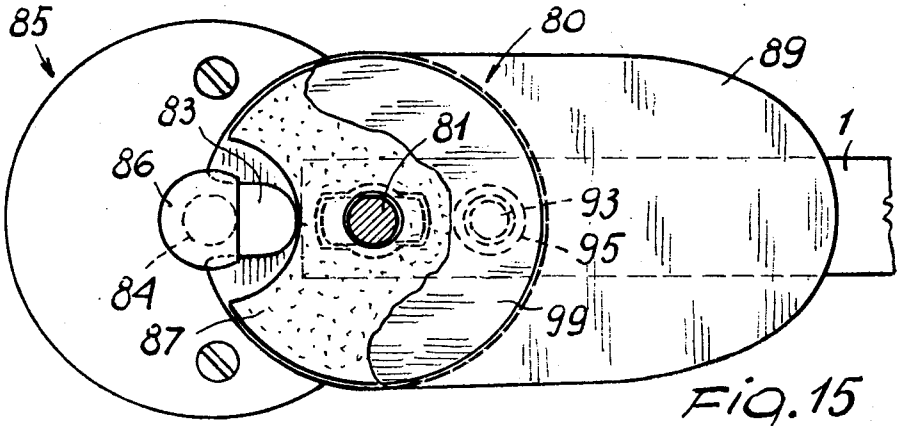
FIG. 15 is a sectional view taken along the line XV—XV of FIG. 16.
Figure 16:
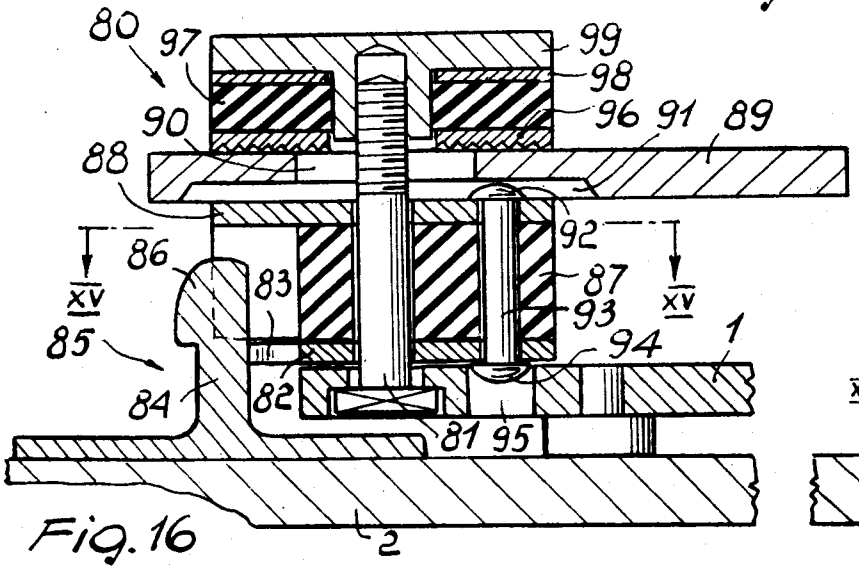
FIG. 16 is a longitudinal section of the front latching means.
Figure 19:
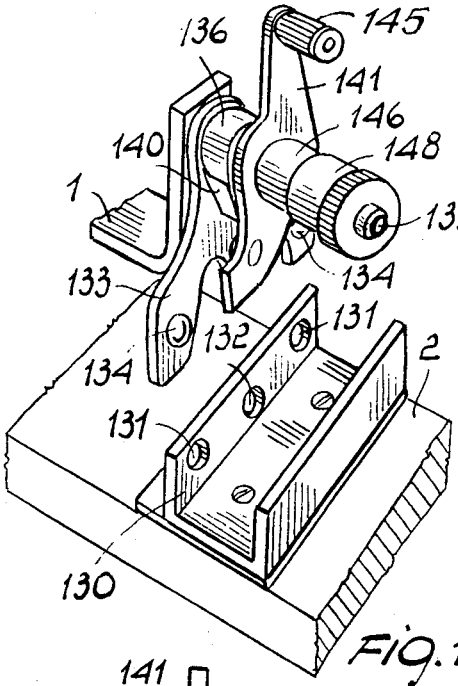
FIG. 19 shows schematically in perspective a further embodiment of the rear latching means.
Figure 20:
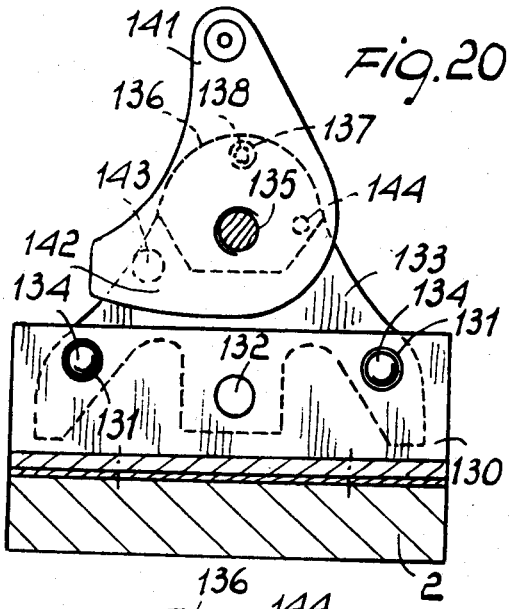
FIG. 20 shows the rear latching means of FIG. 19 in the unlatched position.
Figure 21:
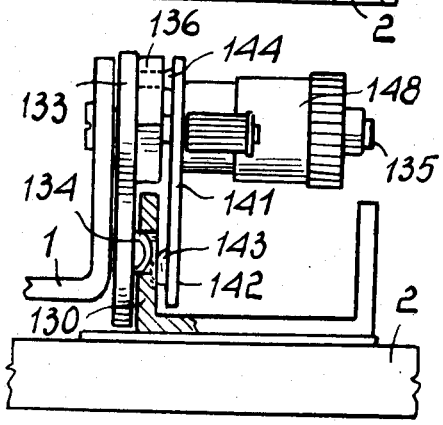
FIG. 21 shows the rear latching means of FIGS. 19 and 20, in side elevation.
Figure 22:
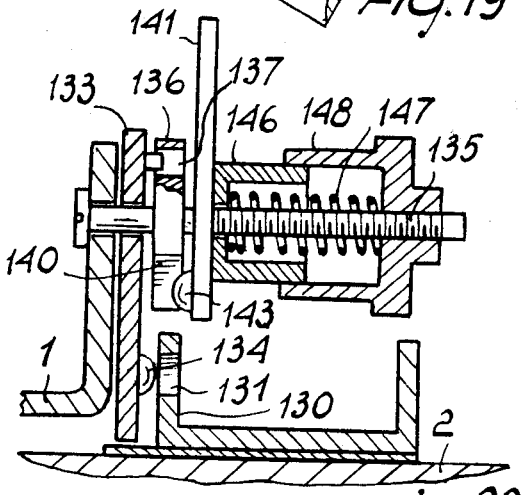
FIG. 22 shows a longitudinal section of the rear latching means of FIGS. 19 to 21.
Figure 23:
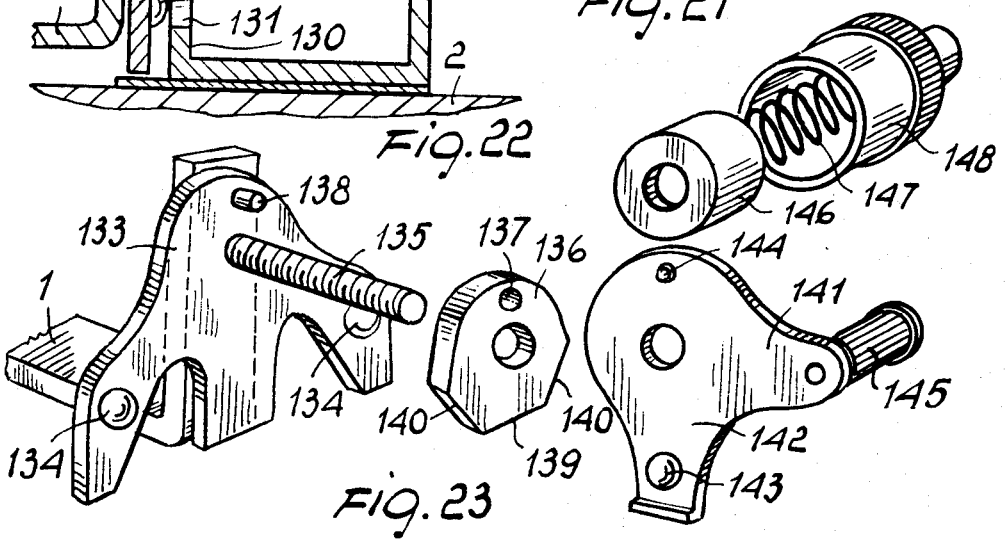
FIG. 23 shows the rear latching means of FIGS. 19 to 22, in an exploded view.

With reference to FIGS. 15 and 16, there are shown front latching means, generally indicated at 80, which have a non-rotatable front link 81, which extends perpendicularly upwards from the front end of the bar element 1; around the lower portion of said link, and with a degree of play, there is provided a front latching plate 82 which has of preference a circular configuration and is provided, at its front portion, with a yoke or forked seat 83 arranged to surround a stem 84 of a front stud 85 which is secured to the ski 2 and has a widened head 86 and, if desired, a rear vertical bevel towards said seat 83 effective to allow a certain play between the front latching means 80 and pin or stud 85.

Located above said front latching plate 82 around the link 81 there is provided a first front elastic pad 87 overlaid by a front clamping plate 88 of circular shape, which is in turn overlaid by a shackle element 89 of oblong shape having an elongate slot 90 adapted for being freely crossed by said link 81; moreover, on the lower face of the shackle element 89, there is provided an elongated groove 91 extending in the same direction as the slot 90. In the groove 91 there enters the upper head 92 of a clamping pin 93 which extends across the front latching plate 82, the first front elastic pad 87 and the front clamping plate 88, and which has a lower head 94 located below the front latching plate 82 and received in a front groove or keyway 95 in the bar 1.

On the shackle element 89, there is provided a friction plate 96 which is overlaid by a second front elastic pad 97, the pad 97 being compressed at the top, with the interposition of a washer 98, by a front cap 99 which is threaded onto the upper threaded end of the front link 81.

The described front latching means 80 have the additional function of locking the boot or footwear 3 with respect to the bar element 1; in fact, and as shown already, it can be noticed that the footwear 3 would otherwise be allowed to move longitudinally with respect to the bar element 1; however, the shackle element 89 is provided which, during the insertion of the head 7 of the pin 6 of the footwear 3 through the slot 4, is rotated such as to lay on one side and allow longitudinal movement of the footwear 3 on the bar element 1. In order to lock the footwear, the shackle element 89 is rotated back such as to engage its rear end portion with the toe end of the footwear and prevent any longitudinal displacement of the latter, after the pin 6 has been located in the slot 4. The provision for the slot 90 affords the possibility for the user to adjust at will the length of that portion of the shackle element 89 which protrudes towards the footwear, thus accommodating for the various footwear sizes.

Once the user has positioned the shackle element 89, it will remain in position, owing to the presence of the pressed friction plate 96, without moving longitudinally and thus allowing accurate adjustment of the fastener.

Furthermore, the cited front latching means 80 also permit side release, in the event of a sideward stress as due to excessive torque; under these circumstances the lower head of the clamping pin 93 comes out of the front groove or keyway 95 to permit rotation of the front latching means about the front link 81 and consequent disengagement of the yoke seat 83 from the front pin 85.

The cited front latching means 80 also afford upward release; in fact, in the event of an upwardly directed stress, the latching plate 82 would, by overcoming the elastic bias of the pads 87 and 97, tend to take an angle with respect to the front link 81, and thanks also to the deflection which is unavoidably induced on the bar element 1, the yoke seat 83 of the plate 82 is enabled to disengage itself from the pin 85, thus effecting the automatic release of the bar element 1.

Figure 17:
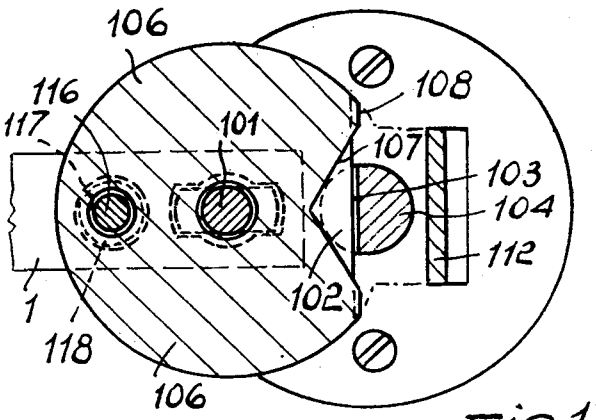
FIG. 17 is a sectional view taken along the line XVII—XVII of FIG. 18.
Figure 18:
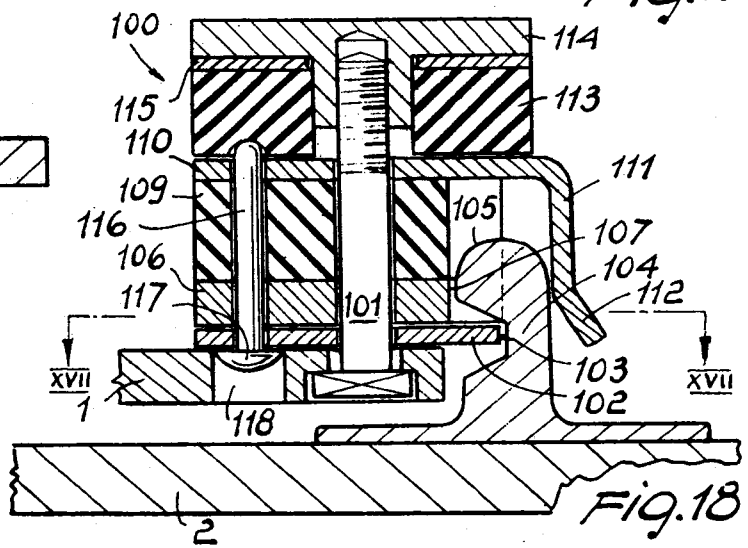
FIG. 18 is a longitudinal sectional view of another embodiment of the rear latching means.

The rear latching means, generally indicated at 100, have in the embodiment thereof illustrated in particular in FIGS. 17 and 18 a non-rotatable rear link 101, which extends perpendicularly upwards from the rear end of the bar element 1; a rear latching plate 102 is arranged, with a certain amount of play, around the cited link 101 and is received, in the latched position, inside a recess 103 provided on the front side surface of a rear pin or stud 104 secured to the ski 2 and having a rounded head 105 above the recess 103. Above said rear latching plate 102, there is provided a rear plate 106 for side release which is accommodated around the rear link 101 and has, in its rear portion, a seat 107 with sloping and converging side surfaces, said seat being arranged to receive the pin or stud 104 and having its free ends 108 located laterally to the pin 104. Located above the rear side release plate 106, is a first rear elastic pad 109, which is overlaid by an intermediate plate 110 having at its rear portion a tab 111 which extends downwards towards the pin or stud 104 and terminates in a rearwardly sloping end portion 112 defining a lead-in member for snap-engaging the rear latching means 100 with the pin or stud 104. Said tab 111, with the rear latching means 100 engaged with the pin 104, engages the rear portion of the pin 104 to create in cooperation with the plates 102 and 106 a resilient clamp effective to provide removable coupling in all directions of the rear latching means 100 to the rear pin 104.

At the top of the intermediate plate 110, there is provided a second rear elastic pad 113 which is pressed with the interposition of a rear washer 115 against the intermediate plate 110 by means of a rear cap 114 which is threaded onto the threaded free end of the rear link 101. Moreover, a pin 116 is provided which extends parallel to the rear link 101 and interconnects the rear latching plate 102 and intermediate plate 110 to prevent any relative rotation thereof; at the bottom, below the plate 102, the pin 116 has a rounded head 117 which engages with a rear groove or keyway 118 formed in the bar element 1. The cited rear latching means 100 are configurated such as to oppose with a resistance a downward side release, which resistance is anyhow different from the upward release resistance; in fact, to accomplish the upward release, it is necessary that the rear end of the rear latching plate 102 be disengaged from the recess 103; since said recess has a considerable extension, it will be necessary to produce a forward longitudinal sliding movement of the bar element 1, as allowed for by the shape of the yoke seat 83, such as to develop a sufficient force to divaricate towards the rear the tab 111, which affords disengagement from the pin 104.

For sideways releasing, it will be instead sufficient that the plate 106 for sideways release is allowed to move past the pin 104, and more specifically, it will be sufficient that the ends 108 of the seat 107 move beyond the pin 104. Since the interference area of the cited ends 108 is small with respect to the interference area of the plate 102, and the movements in the cases of upward release and sidewards release are accomplished along differently sloping surfaces, it will be appreciated that it is possible to adjust at will and independently from one another the releasing forces required for the upward release and sideways release.

It should be further added to the above that the rearwardly inclined portion 112 of the tab 111 allows for an easy engagement of the rear latching means 100 on the pin or stud 104 by application of a downwardly directed pressure; in this condition, it occurs that the rearward divarication of the tab 111, by deflection of the plates 102 and 110 with respect to the rear link 101, as allowed by the provision of elastic pads 109 and 113, is facilitated in the downward direction, whereas it is made more difficult in the opposite direction. It should be pointed out that through the configuration just described, the clamping action exerted by the tab 111 tends to be weakened by divarication during the application of the rear latching means 100 onto the pin 104, thus facilitating such application, whereas it is strengthened during the release step, thus increasing considerably the force requirement during the release step over the force requirement for the latching step.

Furthermore, added safety is provided for sideways release. In fact, if for a reason whatever, such as binding or snow build-up, it becomes impossible to disengage the seat 107, and more specifically the edges 108, from the rear pin or stud 104 as described above, there would occur, beyond a certain amount of effort, that the rounded head 117 of the pin 116 comes off the rear keyway 118, to produce rotation of the entire rear latching means 100 about the rear link 101, with attendant disengagement of the bar element 1 from the ski, owing to disengagement from the front pin or stud 84.

It should be further pointed out that through rear latching means of the type just described it is no longer necessary to provide at the front an automatic release means, but it is sufficient that a guide notch be provided inside of which the front end of the bar element 1 is received, allowing for a certain amount of longitudinal movement to permit release from the rear latching means.

For completeness sake, it should be added that in order to avoid that the ski may get damaged owing to a certain oscillation of the assembly including the rod-like element 30 and its contact area with the bar element 1, with respect to the ski, there is provided a protective plate, indicated at 120, in FIG. 1 the edges whereof are arranged below the area occupied by the block 33 and cup element 41, such that the same cannot damage the ski.

FIGS. 19 to 23 illustrate a different embodiment of the rear latching means. However, this latter embodiment is also based on the same principle of exerting a sideways release force which is lower than, or anyhow different from, the upward release force. In this embodiment, instead of the rear pin 104, there is provided affixed to the ski 2 a plate member 130 having projecting webs; in the front web there are formed a pair of side seats 131 and a central seat 132; the seats 131 and 132 comprise preferably through holes, such as illustrated in the accompanying drawings.

Rigid with an upwardly bent rear end of the bar element 1, there is provided a fixed plate 133 which is directed substantially perpendicularly to the bar element 1 and has on its rear face a pair of rounded projections 134 which are located at positions corresponding to the side seats 131. Moreover, from said fixed plate 133, there extends rearwardly and substantially parallel to the bar element 1 a threaded pin 135 whereon is slid a cam element, generally indicated at 136, which has at the top a through hole 137 wherein there partially enters a stop pin 138 extending from the fixed plate 133, to prevent the cam element 136 from rotating with respect to the fixed plate 133; said cam element 136 defines at the bottom a flat portion 139 bordered by two inclined portions 140. On the horizontal threaded pin 135 there is arranged a pivotable plate 141 which has a bottom lug 142 whereon there is provided a rear rounded projection 143 adapted for engagement with the cited central seat 132. Moreover, on the pivotable plate 141, there is provided a locating pin 144 adapted for insertion into the through hole 137 of the cam element 136 to provide the correct rest position of the plate 141 with respect to the fixed plate 133. A small knob 145 is further provided on the plate 141 for performing the rotation of the pivotable plate 141 manually. Moreover, there is provided on the pin 135 a sleeve 146, which is urged against the pivotable plate 141, by a coil spring 147 the load whereof is adjustable through a cap bushing 148 which is screwed on the pin 135.

In the in-use position, i.e. with the rear latching means connected to the ski, the rounded projections 134 are inserted in the side seats 131, while the rear rounded projection 143 is received in the central seat 132 because of the action of the spring 147 which resiliently urges the pivotable plate against the projecting front web of the plate member 130; in this manner the fixed plate 133 and pivotable plate 141 form in practice a clamp structure which provides a stable positioning.

As stresses occur, e.g. upwardly acting stresses, and these stresses exceed a level which is considered to be safe, it occurs that the clamp comprising the plates 133 and 141 tends to open, such that the projections 134 and 143 disengage from the respective seats overcoming in this case the resilient resistance opposed by the preload spring 147 whereby the bar element 1 is released from the ski 2.

By contrast, in the case of sideways efforts, it is sufficient that the rounded projections 134 only come out of their seats 131, whereas the rear rounded projection 143 stays in the central seat 132 to cause the plate 141 to rotate, while permitting the release of the bar element 1 from the ski 2. This release occurs, however, with a smaller force because as mentioned hereinabove it is sufficient that one part only of the rounded projections, i.e. the projections 134, move out of their seats.

The inclined portions 140 have the function of maintaining the position of the plate 141, which is thus enabled to rotate through a limited angle in one direction or the other, as far as the projection 143 stops against the one or the other of the inclinded portions 140, thus allowing the possibility for the user of easily and quickly restoring the normal operating conditions.

To secure the rear latching means, the user is already able to directly arrange the projections 134 and 143 at the correct point, and then apply a downwardly directed force which permits the fixed plate 133 and pivotable plate 141 to be moved away from each other enough to allow the projections 134 and 143 to be inserted into the respective seats 131 and 132. If desired, it is also possible to position the pivotable plate 141 such as to have its rear rounded projection 143 facing one of the inclined portions 140, and after having positioned the projection 134 at the seats 131, it is possible to rotate plate 141 manually to insert the projection 143 into the central seat 132, thus completing the coupling.

It will be appreciated from the foregoing description that the invention achieves its objects, and in particular it is pointed out that the fastening structure described herein permits first of all the utilization of a soft type of footwear in that it provides the rod-like element 30 which is effective to prevent any side oscillation of the skier's leg with respect to the ski, to afford corner holding capabilities.

Moreover, through the embodiment just described, it happens that there is elminated any strap or hook for connection of the skier's leg to the rod-like element 30, in that it is the elastic means provided on the rod-like element 30 that maintains at all times the rod-like element 30 in contact with the leg, thus preventing any incidental decoupling.

It should be added to the foregoing that by providing rear and front automatic release latching means, which work independently of each other, the various release systems are rendered extremely safer, while increasing considerably the variety and range of the usable types of ski fasteners.

The invention as described is susceptible to several modifications and variations all of which fall within the scope of the instant inventive concept.

Moreover, all of the details may be replaced by other technically equivalent elements.

In practicing the invention, the materials employed, as well as the shapes and dimensions, may be any ones to suit individual requirements.

I claim:

1. A ski fastener structure comprising a substantially rigid bar element having a front end and a rear end, front latching means at said front end and rear latching means at said rear end for removably connecting said bar element to a ski, a rod-like element having one end pivotally connected to said bar element about an axis transverse thereto at said rear end and another end having means for engaging a skier's leg from the rear, resilient means between said bar element and said rod-like element for holding said rod-like element in engagement with said skier's leg in a number of inclined positions of said skier's leg during skiing, means at a front sole portion and at a rear sole portion of a skier's footwear and at a front portion and at a rear portion of said bar element for removably connecting said footwear to said bar element such as to allow lengthwise movement of said footwear on said bar element between a disengaged position and an engaged position of said footwear with said bar element, and means for holding said footwear on said bar element in said engaged position.

2. A ski fastener structure as claimed in claim 1, wherein said means for removably connecting said footwear to said bar element comprise an elongate slot in said front portion of said bar element, said elongate slot having a widened portion at one end thereof, a longitudinal channel in said front sole and said rear sole portion of said footwear, a front stud in said front sole portion projecting into said longitudinal channel, said front stud having a head having a cross dimension greater than said elongate slot and less than said widened portion of said elongate slot, a rear stud in said rear sole portion and projecting into said longitudinal channel, and a resilient reed of substantially U-like shape on said rear portion of said bar element for snap-engaging said rear stud.

3. A ski fastener structure as claimed in claim 2, wherein said resilient reed has a bottom portion accommodated below said bar element, two side arms extending upwardly from said bottom portion and each having a downwardly curled edge, said edges being oriented toward each other and defining a seat for receiving said rear stud, and hook members at both ends of said reed for coupling said reed to said bar element with longitudinal sliding movement capabilities of said reed along said bar element.

4. A ski fastener structure as claimed in claim 1, wherein said means for removably connecting said footwear to said bar element comprise an elongate slot in said front portion of said bar element, said elongate slot having a widened portion followed by a narrowed portion at a rear end of said slot, a longitudinal channel in said front sole and said rear sole portion of said footwear, a front stud in said front sole portion projecting into said longitudinal channel, said front stud having a head having a cross dimension greater than said narrowed portion and less than said widened portion of said elongate slot, said head further having a front bevel defining a front head portion flush with a front portion of said stud, a rear stud in said rear sole portion and projecting into said longitudinal channel, and a resilient reed of substantially U-like shape on said rear portion of said bar element for snap-engaging said rear stud, and wherein said means for holding said footwear on said bar element in said engaged position comprise a tab element in said elongate slot, a reed member hingedly connecting a front end of said tab element to said bar element, said tab element having a lead-in taper on a rear end, said reed resiliently holding said tab element in a position in which said rear end of said tab element defines an abutment for said front stud when housed in said narrowed portion of said elongate slot to prevent said front stud and said footwear from moving lengthwise with respect to said bar element.

5. A ski fastener structure as claimed in claim 1, wherein said rod-like element has a pin rigid therewith at said one end and said bar element has a support body secured thereto for pivotally receiving said pin, said pin and said rod-like element being rigid with a block arranged beside and facing said body and having a pair of stop pegs positioned diametrically opposite with respect to said pin, said body having a pair of keyways contoured as an arc of a circle for receiving said stop pegs, and said keyways each having ends defining a front stop and a rear stop for a respective one of said stop pegs.

6. A ski fastener structure as claimed in claim 5, further comprising elastic blocks at the ends of said contoured keyways defining said rear stop, said elastic blocks serving as elastic detents for said rod-like element when rotated backwards.

7. A ski fastener structure as claimed in claim 1, wherein said rod-like element has a pin rigid therewith at said one end and said bar element has a support body secured thereto for pivotally receiving said pin, said pin and said rod-like element being rigid with a block arranged beside and facing said body, and wherein said means for holding said rod-like element in engagement with said skier's leg comprise a cup element arranged around said pin at one side of said body opposite to said block, means for adjustably locking said cup element angularly with respect to said pin, and a coil spring arranged around said pin within said cup element and having one end secured to said body and another end secured to said cup element.

8. A ski fastener structure as claimed in claim 7, wherein said means for locking said element angularly with respect to said pin comprise a threaded portion on said pin, a locknut screwed on said threaded portion of said pin, a cup-like member arranged between said locknut and said cup element and having a front end facing said cup element, a plurality of mating recesses in said front end and said cup element facing each other, balls in said mating recesses, and a tightening locknut for tightening said cup element axially against said cup-like member by interposition of said balls.

9. A ski fastener structure as claimed in claim 1, wherein said means for engaging a skier's leg from the rear comprise a cross sleeve connected to said rod-like element at said another end thereof, a cross pin rotatable within said cross sleeve and having end portions projecting from said cross sleeve, an arm secured to one of said end portions and a resiliently divaricable arm on the other of said end portions of said cross pin, and elastic friction pads on said cross pin between said arms and said cross sleeve.

10. A ski fastener structure as claimed in claim 9, further comprising a yoke element secured to said another end portion of said cross pin between said divaricable arm and a respective one of said elastic friction pads, said yoke element having a bevel at one end facing said divaricable arm, and a resiliently biased plunger projecting from said bevel and resiliently engaging one end of said divaricable arm, said divaricable arm being pivotally supported by said yoke element about an axis extending transverse to said cross pin.

11. A ski fastener structure as claimed in claim 9, wherein said rod-like element is a hollow rod member and said cross sleeve is rigid with a rod portion lengthwise slidable within said hollow rod member.

12. A ski fastener structure as claimed in claim 1, wherein said rear latching means comprise a body secured to said rear end of said bar element and pivotally supporting said rod-like element, a through channel in said body, a resilient plate within said through channel, said resilient plate having a rear end carrying a hook-up tailpiece for removable engagement with a rear latching stud secured to said ski, a rigid plate adjustably positionable within said through channel in engagement with said resilient plate such as to vary the resiliency of said resilient plate, and means for locking said rigid plate and said resilient plate within said through channel.

13. A ski fastener structure as claimed in claim 12, wherein said hook-up tailpiece has a concave seat and a snow-discharge through hole ending at said concave seat, and wherein said rear latching stud has a projection arranged to enter said concave seat such as to permit release of said bar element from said ski in various directions through application of respective predetermined forces.

14. A ski fastener structure as claimed in claim 1, wherein said front latching means comprise a front link projecting perpendicularly from said bar element at said front end thereof and having a threaded end spaced from said bar element, a front latching plate arranged with play about said front link and having a forked seat at a front portion thereof for removably receiving a front stud secured to said ski, said front stud having a head having a rear bevel for providing an amount of play between said front stud and said front latching means, a first front elastic pad on said front latching plate around said front link, a front clamping plate of circular shape on said first front elastic pad around said front link, a shackle element of substantially oblong shape having an elongate slot freely crossed by said front line and a lower face having an elongate groove, a clamping pin extending across said front latching plate, said first front elastic pad and said front clamping plate and having an upper head entering said elongate groove and a lower head entering a front groove of said bar element below said front latching plate, a friction plate on said shackle element around said front link, a second front elastic pad on said friction plate around said front link, a washer on said second front elastic pad around said front link, and a front cap threaded onto said threaded end of said front link for holding said friction plate pressed against said shackle element.

15. A ski fastener structure as claimed in claim 14, wherein said shackle element is rotatable about said front link against the elastic bias of said second front elastic pad between a position in which it engages a skier's footwear toe end such as to prevent any longitudinal movement of said footwear on said bar element, and a position in which it is disengaged from said footwear toe end such as to allow longitudinal movement of said footwear on said bar element.

16. A ski fastener structure as claimed in claim 1, wherein said rear latching means comprise a rear link projecting perpendicularly from said bar element at said rear end thereof and having a threaded portion spaced from said bar element, a rear latching plate arranged with play about said rear link for removable engagement with a recess of a rear stud secured to said ski, said rear stud having a rounded head above said recess, a rear side release plate on said rear latching plate around said rear link, said rear side release plate having a rear seat having converging side surfaces between which said head of said rear stud is received, a first rear elastic pad on said rear side release plate around said rear link, an intermediate plate on said first rear elastic pad around said rear link, said intermediate plate having a rear tab bent towards said rear stud for rearwardly engaging said rear stud, a second rear elastic pad on said intermediate plate around said rear link, a washer on said second rear elastic pad around said rear link, and a rear cap threaded onto said threaded portion of said rear link for holding said second rear elastic pad pressed against said intermediate plate.

17. A ski fastener structure as claimed in claim 16, wherein said rear tab has a rearwardly sloping end portion defining a lead-in member for snap engaging said rear latching means with said rear stud.

18. A ski fastener structure as claimed in claim 16, further comprising a pin extending substantially parallel to said rear link and interconnecting said rear latching plate and said intermediate plate to prevent any relative rotation thereof, said pin having a rounded head below said rear latching plate for engaging a rear groove formed in said bar element.

19. A ski fastener structure as claimed in claim 1, wherein said rear latching means comprise a fixed plate secured to said rear end of said bar element and directed substantially perpendicularly to said bar element, a pair of rounded projections on said fixed plate for insertion into a pair of corresponding side seats of a projecting web of a plate member secured to said ski, a threaded pin rearwardly projecting from said fixed plate substantially parallel to said bar element, a pivotable plate arranged on said threaded pin and having a rounded projection for insertion into a central seat of said projecting web of said plate member, and means for resiliently urging said pivotable plate toward said projecting web of said plate member.

20. A ski fastener structure as claimed in claim 19, further comprising a cam element arranged on said threaded pin between said fixed plate and said pivotable plate, a through hole in said cam element, a stop pin rigid with said fixed plate and partially entering said through hole, a locating pin on said pivotable plate for engagement with said through hole in a rest position of said pivotable plate, said cam element further having two inclined portions defining stops for said rounded projection of said pivotable plate during rotation of said pivotable plate.

21. A ski fastener structure as claimed in claim 19, wherein said means for resiliently urging said pivotable plate toward said projecting web of said plate member comprise a sleeve around said threaded pin, a cap bushing screwed on said threaded pin, and a coil spring around said threaded pin within said sleeve and between said cap bushing and said pivotable plate.

* * * * *